US010975792B2

(12) United States Patent
Takada

(10) Patent No.: US 10,975,792 B2
(45) Date of Patent: Apr. 13, 2021

(54) EXHAUST PIPE TEMPERATURE ESTIMATION DEVICE AND SENSOR HEATER CONTROL APPARATUS FOR EXHAUST GAS SENSOR USING EXHAUST PIPE TEMPERATURE ESTIMATION DEVICE

(71) Applicant: Hitachi Automotive Systems, Ltd., Hitachinaka (JP)

(72) Inventor: Kenji Takada, Hitachinaka (JP)

(73) Assignee: HITACHI AUTOMOTIVE SYSTEMS, LTD., Hitachinaka (JP)

( * ) Notice: Subject to any disclaimer, the term of this patent is extended or adjusted under 35 U.S.C. 154(b) by 80 days.

(21) Appl. No.: 16/322,081

(22) PCT Filed: Jul. 7, 2017

(86) PCT No.: PCT/JP2017/024905

§ 371 (c)(1),
(2) Date: Jan. 30, 2019

(87) PCT Pub. No.: WO2018/025578

PCT Pub. Date: Feb. 8, 2018

(65) Prior Publication Data

US 2019/0186399 A1 Jun. 20, 2019

(30) Foreign Application Priority Data

Aug. 5, 2016 (JP) ..... JP2016-154184

(51) Int. Cl.
*F02D 41/14* (2006.01)
*F02D 45/00* (2006.01)
(Continued)

(52) U.S. Cl.
CPC ..... *F02D 41/1494* (2013.01); *F01N 3/00* (2013.01); *F01N 3/24* (2013.01); *F02D 41/1447* (2013.01);
(Continued)

(58) Field of Classification Search
CPC ..... F02D 41/1494; F02D 41/1447; F02D 41/1458; F02D 41/263; F02D 45/00; F01N 3/00; F01N 3/24
(Continued)

(56) References Cited

U.S. PATENT DOCUMENTS 6,286,366 B1 * 9/2001 Chen ..... F02D 41/32 73/114.31
2007/0000235 A1 1/2007 Ohsaki
2013/0024088 A1 * 1/2013 Suzuki ..... F02D 41/1494 701/102

FOREIGN PATENT DOCUMENTS

JP 2002-048749 A 2/2002
JP 2004-316594 A 11/2004
(Continued)

OTHER PUBLICATIONS

International Search Report and Written Opinion issued in PCT/JP2017/024905 dated Nov. 7, 2017.

*Primary Examiner* — Joseph J Dallo
*Assistant Examiner* — Yi-Kai Wang
(74) *Attorney, Agent, or Firm* — Foley & Lardner LLP

(57) ABSTRACT

Provided are a novel exhaust pipe temperature estimation device and a sensor heater control apparatus for an exhaust gas sensor using the same that accurately estimates an estimation exhaust pipe temperature when an internal combustion engine is stopped and restarted in response to a change of an environmental condition of the internal combustion engine and controls an operation of a sensor heater based on the estimated estimation exhaust pipe temperature. Thus, at least first correction information Tz based on a change of an exhaust pipe temperature and an elapsed time at stop, second correction information Ty based on a change of an internal combustion engine temperature at the stop of the internal combustion engine, and third correction information Tz based on a change of a cooling degree due to outdoor air during stop from the stop to restart are obtained, an estimation exhaust pipe temperature at the stop is corrected using at least one or more pieces of the correction information at restart of the internal combustion engine to estimate an estimation exhaust pipe temperature at the
(Continued)

restart, and an estimation exhaust pipe temperature during an operation of the internal combustion engine thereafter is obtained using the estimation exhaust pipe temperature as an initial value, and further, a heating operation of a sensor heater is started when the estimation exhaust pipe temperature becomes equal to or higher than a predetermined value.

12 Claims, 9 Drawing Sheets

(51) Int. Cl.
*F01N 3/00* (2006.01)
*F01N 3/24* (2006.01)
*F02D 41/26* (2006.01)

(52) U.S. Cl.
CPC ..... *F02D 41/1458* (2013.01); *F02D 41/263* (2013.01); *F02D 45/00* (2013.01)

(58) Field of Classification Search
USPC ..... 123/697
See application file for complete search history.

(56) References Cited

FOREIGN PATENT DOCUMENTS

| | | | |
|---|---|---|---|
| JP | 2007-009878 | A | 1/2007 |
| JP | 2013-024093 | A | 2/2013 |
| JP | 2013-163978 | A | 8/2013 |
| JP | 2013-234574 | A | 11/2013 |

* cited by examiner

EXHAUST PIPE TEMPERATURE ESTIMATION DEVICE AND SENSOR HEATER CONTROL APPARATUS FOR EXHAUST GAS SENSOR USING EXHAUST PIPE TEMPERATURE ESTIMATION DEVICE

TECHNICAL FIELD

The present invention relates to an exhaust pipe temperature estimation device of an exhaust pipe of an internal combustion engine and a sensor heater control apparatus for an exhaust gas sensor using the same.

BACKGROUND ART

In internal combustion engines, air-fuel ratio feedback control is performed to control the amount of fuel to be injected from a fuel injection valve by causing an exhaust gas sensor (for example, an oxygen concentration sensor) to face an exhaust pipe and detecting a component of an exhaust gas (for example, oxygen concentration). Further, a sensor element provided in the exhaust gas sensor is generally activated in the state of being heated to a predetermined temperature or higher so that the oxygen concentration can be measured. Therefore, the exhaust gas sensor is provided with a sensor heater for heating the sensor element, and the outer side of the sensor is covered with a metallic protector having a plurality of vent holes configured to protect the sensor element and narrow down the exhaust gas.

In such an exhaust gas sensor, an exhaust gas in the exhaust pipe condenses in the exhaust pipe after a previous engine stop so that water remains at the time of start or cooling before or after start, or an exhaust gas, discharged from the internal combustion engine after start, touches a low-temperature exhaust pipe wall to condense and generate condensate water. Thus, when the condensate water is applied to the sensor element whose temperature has become high due to a heating operation of a sensor heater, there is a problem that damage caused by element cracking of the sensor element may occur due to a thermal shock.

As a countermeasure against such element cracking, for example, JP 2004-316594 A (PTL 1) proposes a technique of providing a temperature sensor outside an exhaust pipe, measuring a temperature of an exhaust pipeline using this temperature sensor, determining whether it is a state where condensate water may exist in the exhaust pipeline based on the temperature, and heating the exhaust pipeline using high-temperature water heated by a combustion burner to evaporate the condensate water if the exhaust pipeline is in the state where the condensate water may exist. In this manner, the damage of the sensor element of the exhaust gas sensor is avoided.

CITATION LIST

Patent Literature

PTL 1: JP 2004-316594 A

SUMMARY OF INVENTION

Technical Problem

In PTL 1, however, the combustion burner to heat the exhaust pipe and a high-temperature water jacket, and the like are provided in the exhaust pipe, it is necessary to greatly change the exhaust pipe. Moreover, there is a problem that additional parts are necessary, and thus, it is desired to avoid damage caused by element cracking of the sensor element without adding parts as much as possible.

Therefore, it is proposed to estimate an exhaust pipe temperature at the next restart of the internal combustion engine based on the change amount in a coolant temperature when the internal combustion engine is stopped and to start an operation of the sensor heater assuming that the condensate water has evaporated when the exhaust pipe temperature is higher than a predetermined value. However, estimation accuracy is low without responding to a change of an environmental condition relating to the internal combustion engine. In particular, automobiles equipped with an idle stop function have become widespread recently, and stop and restart of the internal combustion engine are frequently performed so that it is necessary to accurately estimate the temperature of the exhaust pipe.

Further, when the exhaust pipe temperature is erroneously estimated to be low at the time of restarting the internal combustion engine, a heater control function unit does not heat the exhaust gas sensor by erroneously recognizing that there is a lot of condensate water, and thus, there occurs a problem that the activation of the exhaust gas sensor is delayed and a discharge amount of harmful components of the exhaust gas increases. Conversely, when the exhaust pipe temperature is erroneously estimated to be high, the heater control function unit heats the exhaust gas sensor by erroneously recognizing that the condensate water is little, and thus, there occurs a problem that the condensate water adheres to the high-temperature exhaust gas sensor and causes element cracking.

An object of the present invention is to provide a novel exhaust pipe temperature estimation device and a sensor heater control apparatus for an exhaust gas sensor using the same that accurately estimates an estimation exhaust pipe temperature when an internal combustion engine is stopped and restarted in response to a change of an environmental condition of the internal combustion engine and controls an operation of a sensor heater based on the estimated estimation exhaust pipe temperature.

Here, typical examples of the change of the environmental state include changes of a temporal temperature characteristic due to an exhaust pipe temperature when the internal combustion engine is stopped, a temperature characteristic of a surrounding space of the exhaust pipe, characteristics (wind speed, an atmospheric temperature) of an outside air flowing in the vicinity of the exhaust pipe, and the like.

Solution to Problem

The present invention is characterized by obtaining first correction information based on a change of an exhaust pipe temperature and an elapsed time at stop, second correction information based on a change of an internal combustion engine temperature at the stop of the internal combustion engine, and third correction information based on a change of a cooling degree due to outdoor air during stop from the stop to restart, correcting a stop-time estimation exhaust pipe temperature at the stop using at least one or more pieces of the correction information at restart of the internal combustion engine to estimate a restart-time estimation exhaust pipe temperature at the restart, and obtaining an estimation exhaust pipe temperature during an operation of the internal combustion engine thereafter using the restart-time estimation exhaust pipe temperature as an initial value, and further, starting a heating operation of a sensor heater when the estimation exhaust pipe temperature becomes equal to or higher than a predetermined value.

Advantageous Effects of Invention

Since the restart-time estimation exhaust pipe temperature can be accurately estimated, it is possible to properly heat the exhaust gas sensor and activate the exhaust gas sensor at an early stage while suppressing damage of the sensor element of the exhaust gas sensor. As a result, it is possible to accelerate start of air-fuel ratio feedback and to promote reduction of harmful components of the exhaust gas.

DESCRIPTION OF EMBODIMENTS

An embodiment of the present invention will be described in detail with reference to the accompanying drawings, but the present invention is not limited to the following embodiment, and various modifications and applications that fall within the technological concept of the present invention will be also included in the scope of the present invention.

Prior to describing the embodiment of the present invention, a configuration of an internal combustion engine system to which the present invention is applied will be described first.

Figure 1:
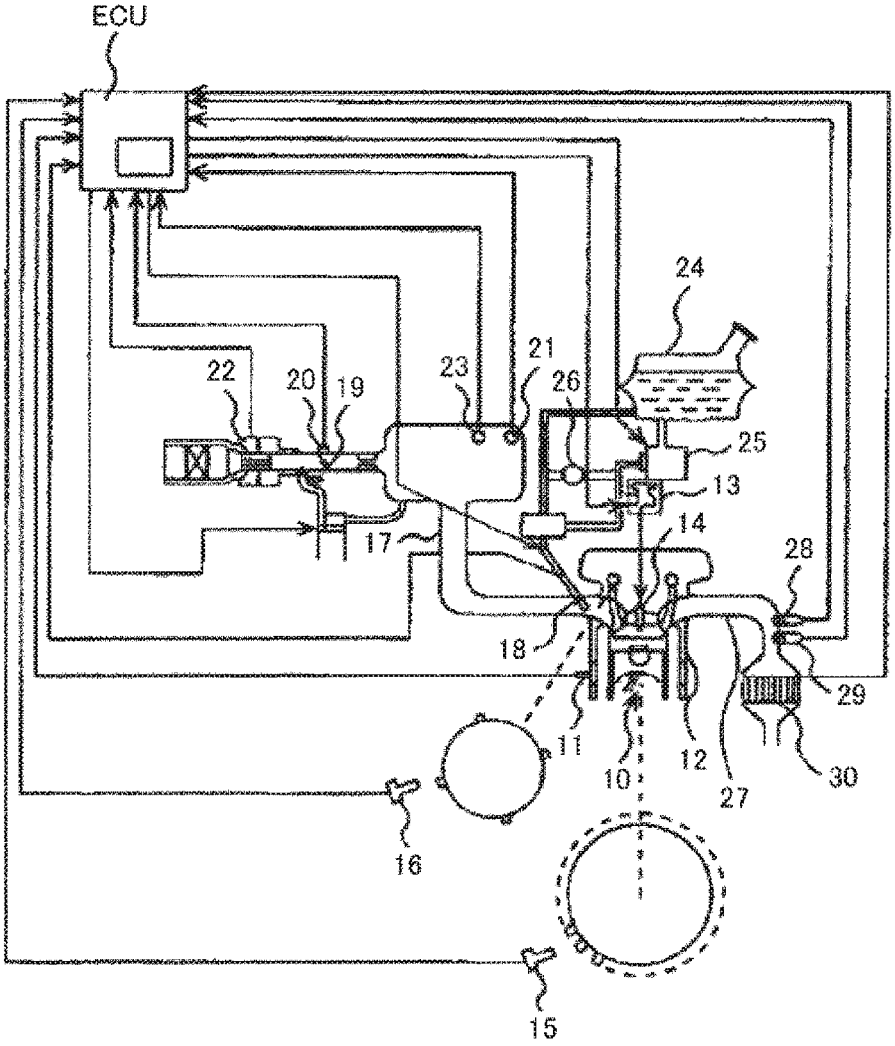
FIG. 1 is a configuration diagram of an internal combustion engine system to which the present invention is applied.

An internal combustion engine 10 illustrated in FIG. 1 includes a combustion chamber formed at the top of a cylinder 12 provided with a temperature state detection unit (water temperature sensor) 11, and a spark plug 14 to which an ignition voltage is applied from an ignition coil 13 is provided in this combustion chamber. A crank angle sensor 15 and a cam angle sensor 16 that detect a rotational phase of a crankshaft and a cam shaft of an intake and exhaust valve mechanism are provided.

A fuel injection valve 18, a throttle valve 19, a throttle position sensor 20, an intake pipe pressure sensor 21, an air flow sensor 22, an intake air temperature sensor 23, and the like are provided in an intake pipe 17 constituting an intake system. Fuel, injected from a fuel tank 24 and adjusted in pressure via a fuel pump 25 and a fuel pressure control valve 26 to a certain pressure, is fed to the fuel injection valve 18.

In addition, an exhaust gas sensor 28, an exhaust temperature sensor 29, an exhaust gas purification catalyst 30, and the like illustrated in FIG. 3 are arranged in an exhaust pipe 27 constituting an exhaust system.

Further, a control device (control unit) ECU to which the present embodiment is applied includes: a sensor heater control function unit that performs control of a sensor heater heating a sensor element provided in the exhaust gas sensor 28; a fuel injection control function unit that performs control of a fuel injection amount and a fuel injection timing by the fuel injection valve 18; and an ignition control function unit that performs control of an ignition timing of the spark plug 14, and the like.

Figure 2:
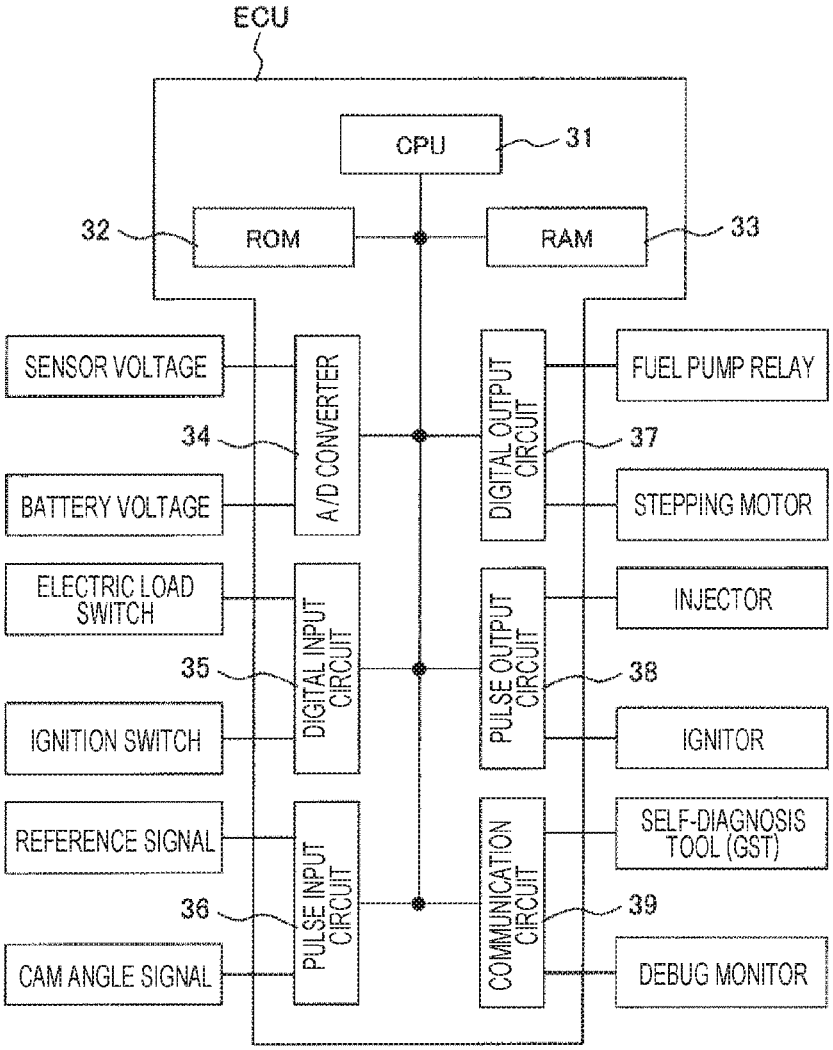
FIG. 2 is a configuration diagram illustrating the configuration of a control device illustrated in FIG. 1.

As illustrated in FIG. 2, the control device ECU is provided with: a CPU 31 performing calculation processing; a ROM 32 storing a program to be executed by the CPU 31 and data used for calculation; and a RAM 33 temporarily storing data.

In addition, the control device ECU includes: an A/D converter 34 that takes an analog signal (a sensor voltage, a battery voltage, or the like) from each sensor and converts the analog signal into a digital signal; a digital input circuit 35 that takes a switch signal (an electric load switch, an ignition switch, or the like) from switches indicating operation states; and an input unit such as a pulse input circuit 36 that counts a time interval of a pulse signal (a reference signal, a cam angle signal, or the like) and the number of pulses within a predetermined time. Further, the control device ECU includes: a digital output circuit 37 that performs an on/off operation of an actuator such as a fuel pump relay and a stepping motor based on a calculation result of the CPU 31; a pulse output circuit 38 that performs an operation of an actuator such as an injector and an igniter; and a communication circuit 39 that communicates with a self-diagnosis tool and a debug monitor. Incidentally, the communication circuit 39 outputs data to the outside and can change an internal state by a communication command from the outside.

Figure 3A:
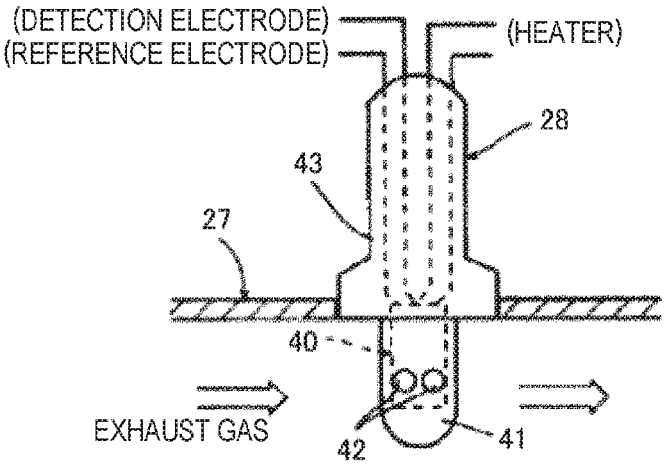
FIG. 3A is a configuration diagram illustrating a schematic configuration of an exhaust gas sensor.
Figure 3B:
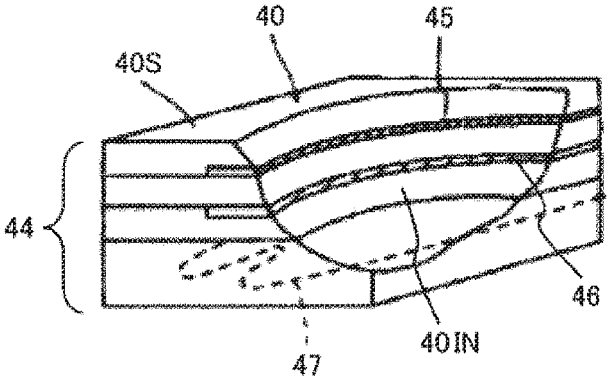
FIG. 3B is a partial cross-sectional view of a sensor element of the exhaust gas sensor.

FIGS. 3A and 3B illustrate a schematic configuration of the exhaust gas sensor, and the exhaust gas sensor 28 is fixed to exhaust pipe 27, a sensor element 40 is arranged inside the exhaust pipe 27, and the sensor element 40 is covered with a protector 41 in the FIG. 3A. A small hole 42 is formed in the protector 41 such that an exhaust gas flows into the protector 41 to contact the sensor element 40. In addition, a heater wire to which a sensor cylinder 43 is fixed and which supplies power to the sensor heater and a signal detection line connected to a reference electrode and a detection electrode of the sensor element 40 are provided outside the exhaust pipe 27.

In the sensor element, a detection electrode 45 and a reference electrode 46 are arranged between stacked substrates 44, and a sensor heater 47 is also arranged so as to heat each electrode as illustrated in FIG. 3B. Therefore, the substrate 44 can be heated by energizing the sensor heater 47 to activate the detection electrode and the reference electrode, and air-fuel ratio feedback can be started in this state.

Figure 4:
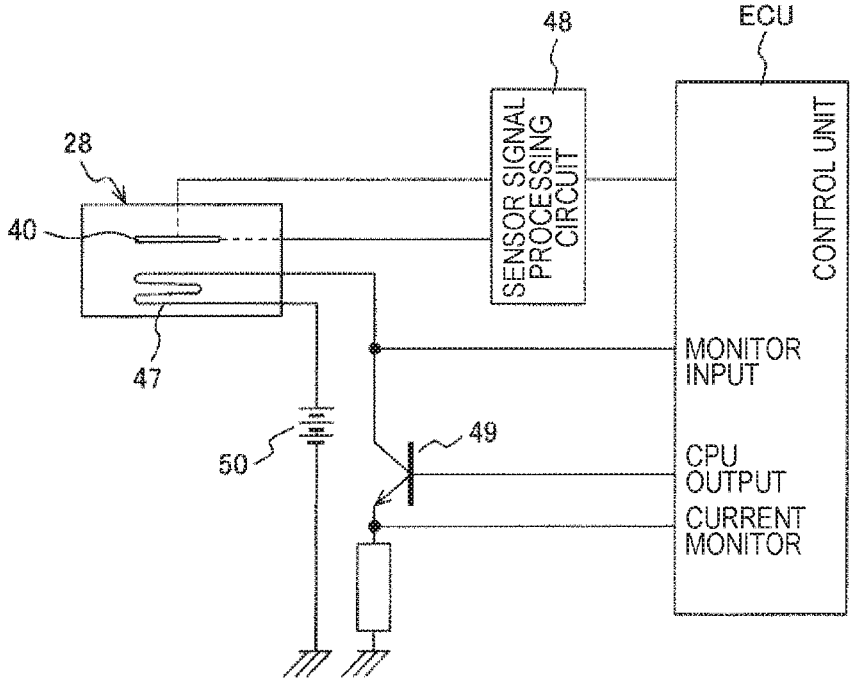
FIG. 4 is a configuration diagram illustrating a connection state between an exhaust gas sensor and the control device.

FIG. 4 illustrates a connection relationship between the control device ECU, the exhaust gas sensor 28, and the sensor heater 47, and a signal indicating an oxygen concentration obtained from the sensor element 40 of the exhaust gas sensor 28 is supplied to the control device ECU via a sensor signal processing circuit 48. In addition, the sensor heater 47 is energized by a battery 50 in response to ON (conduction)/OFF (non-conduction) of a transistor 49, and generates heat in response to an energization quantity (time), thereby heating the sensor element 40.

Further, a control signal (duty signal) to turn on/off the transistor 49 is supplied from the control device ECU in order to control a heating temperature. Incidentally, voltage values (or current values) at both ends of the transistor 49 are used for failure diagnosis or the like of the sensor heater 47, and thus, are taken into a monitor input terminal of the control device ECU. Incidentally, the transistor 49 is controlled by the sensor heater control function unit provided in the control device ECU.

Figure 5:
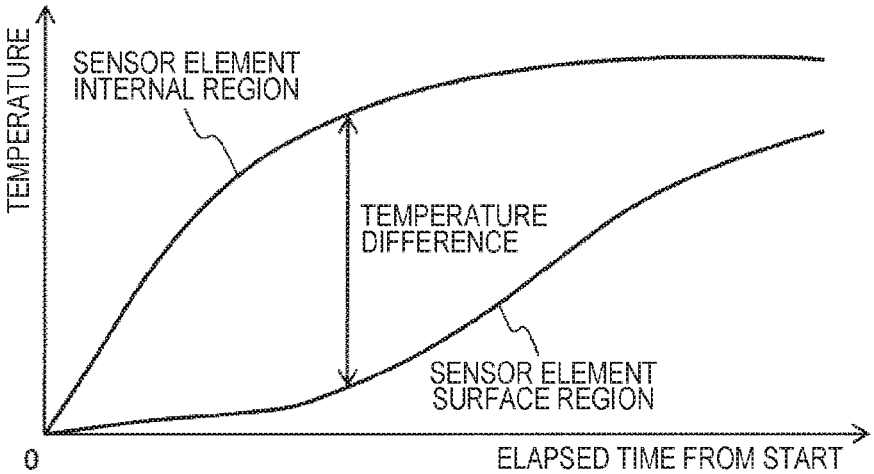
FIG. 5 is a characteristic graph illustrating temperature changes of a surface region and an internal region of the sensor element.

Next, a temperature rise of the sensor element of the exhaust gas sensor immediately after starting the internal combustion engine will be described with reference to FIG. 5.

Moisture is generated by combustion reaction immediately after starting the internal combustion engine, the generated moisture becomes water vapor to be discharged into the atmosphere if the temperature of the exhaust pipe 27 is equal to or higher than a dew point. However, if the temperature of the exhaust pipe 27 is below the dew point, the moisture becomes condensed as water droplets on a wall surface of the exhaust pipe 27, and moisture (condensate water) also adheres to a surface region 40S of the sensor element 40 illustrated in FIG. 3B.

When the sensor element 40 is heated by the sensor heater 47 in this state, the condensate water adhering to the surface region 40S of the sensor element 40 starts to evaporate. Thus, a temperature difference between the surface region 40S of the sensor element 40 and an internal region 40IN of the sensor element 40 where the sensor heater 47 is arranged increases due to the heat of vaporization so that the substrate 44 forming the sensor element 40 may be damaged by a thermal shock.

In addition, the condensate water adhering to the wall surface of the exhaust pipe 27 is scattered by the flow of the exhaust gas, but a part of the condensate water scattered from the wall surface of the exhaust pipe 27 adheres to the surface region 40S of the heated sensor element 40 if the sensor element 40 is heated by the sensor heater 47 at this time, and the substrate 44 of the sensor element 40 may be similarly damaged by the thermal shock.

Therefore, if a time until an internal temperature of the exhaust pipe 27 rises and the condensate water evaporates is determined in advance and the starting operation of the sensor heater 47 is delayed until this time elapses, the damage of the sensor element 40 of the exhaust gas sensor can be prevented. However, the exhaust gas sensor is not heated until the preset predetermined time elapses, it is difficult to activate the exhaust gas sensor at an early stage, the start of the air-fuel ratio feedback is delayed, and the discharge amount of harmful exhaust gas components increases, which is not preferable.

Thus, a technique of estimating an estimation exhaust pipe temperature at the next restart of an internal combustion engine based on a change amount in a coolant temperature when the internal combustion engine is stopped, and starting the operation of the sensor heater assuming that the condensate water has evaporated when the estimated estimation exhaust pipe temperature is higher than a predetermined value is proposed in the related art. However, this technique does not correspond to a change of an environmental condition relating to the internal combustion engine, and estimation accuracy is low.

Further, when the exhaust pipe temperature is erroneously estimated to be low at the time of restarting the internal combustion engine, a heater control function unit does not heat the exhaust gas sensor by erroneously recognizing that there is a lot of condensate water, and thus, there occurs a problem that the activation of the exhaust gas sensor is delayed and a discharge amount of harmful components of the exhaust gas increases. Conversely, when the exhaust pipe temperature is erroneously estimated to be high, the heater control function unit heats the exhaust gas sensor by erroneously recognizing that the condensate water is little, and thus, there occurs a problem that the condensate water adheres to the high-temperature exhaust gas sensor and causes element cracking.

Embodiment

Therefore, the embodiment of the present invention proposes an exhaust pipe temperature estimation device and a sensor heater control apparatus for an exhaust gas sensor using the same which accurately estimates an estimation exhaust pipe temperature when an internal combustion engine is stopped and restarted in response to a change of an environmental condition of the internal combustion engine or the like, obtains an estimation exhaust pipe temperature using such an estimated estimation exhaust pipe temperature as an initial value, and controls an operation of a sensor heater based on the obtained estimation exhaust pipe temperature.

Next, details of the present embodiment will be described with reference to FIGS. 6 to 12. In the present embodiment, the control device ECU determines a condensate water adhesion state of the surface region 40S of the sensor element 40 at restart of the internal combustion engine based on the restart-time estimation exhaust pipe temperature, and performs warm-up control so as to suppress a temperature (heating amount) of the sensor heater 47 to a relatively low temperature immediately after the restart without rapidly increasing the temperature as in the related art when there is a possibility that the condensate water is adhering to the surface region 40S, and to suppress the temperature of the sensor heater 47 to be low such that a temperature difference between the internal region 40IN near the sensor heater 47 of the sensor element and the surface region 40S does not exceed a predetermined value.

The warm-up control is continued until it is regarded that the condensate water in the surface region 40S of the sensor element 40 has almost evaporated. A period until the evaporation of the condensate water is determined based on the estimation exhaust pipe temperature that rises due to an operation of the internal combustion engine, with a restart-time estimation exhaust pipe temperature as a starting point (initial value) at the restart. That is, the condensate water adhesion amount is estimated based on the estimation exhaust pipe temperature, and thus, it is determined that the condensate water in the surface region 40S of the sensor element 40 has almost evaporated when reaching the estimation exhaust pipe temperature which is regarded to have no condensate water adhesion. Therefore, it is important to accurately estimate an initial value (Tp*) of the restart-time estimation exhaust pipe temperature at the restart as the starting point.

Further, sensor activation promotion control is executed to increase electric power to the sensor heater 47 to increase the temperature of the sensor element 40 to an activation temperature (about 600° C. or higher) from the time when the estimation exhaust pipe temperature reaches the predetermined value and it is estimated that the condensate water has almost evaporated.

Further, when and after the sensor element 40 reaches an activation temperature, the temperature of the sensor element 40 is maintained so as to operate at an optimum temperature (for example, about 750 to 760° C.) by temperature feedback control. Incidentally, although an actual temperature of the sensor element 40 is necessary for the temperature feedback control, the actual temperature of the sensor element 40 can be obtained based on a current signal obtained from the sensor element 40 when the temperature of the sensor element 40 reaches 400° C. to 500° C.

Since the estimation of the condensate water adhesion amount on the surface region 40S of the sensor element 40 at the restart of the internal combustion engine differs depending on the estimation exhaust pipe temperature of the exhaust pipe 27 at the restart, the restart-time estimation exhaust pipe temperature at the time of restart is accurately estimated in response to the change of the environmental condition of the internal combustion engine or the like in the present embodiment. This estimation method will be described in detail below. Here, typical examples of the change of the environmental state include changes of a temporal temperature characteristic due to an exhaust pipe temperature when the internal combustion engine is stopped, a temperature characteristic of a surrounding space of the exhaust pipe, characteristics (wind speed, an atmospheric temperature) of an outside air flowing in the vicinity of the exhaust pipe, and the like.

Next, a method of obtaining the condensate water adhesion amount (condensate water amount) based on the estimation exhaust pipe temperature will be described. The control device ECU estimates a condensate water amount Mcon generated in the exhaust pipe 27 by a condensate water amount estimation function unit. Hereinafter, a method of estimating the condensate water amount Mcon generated in the exhaust pipe 27 will be described. Incidentally, an intake air amount, a rotational speed, a coolant temperature, and the like to be described below are well known as the operation state quantities of the internal combustion engine, and information other than these can also be handled as the operation state quantity of the internal combustion engine.

Now, a water vapor amount per unit time Mwgs [g/s] generated by a combustion reaction of fuel and intake air is calculated based on an intake air amount per unit time Mair [g/s] supplied to the internal combustion engine and a fuel injection amount per unit time Mfuel [g/s]. In addition, an estimation exhaust gas temperature Tg (for example, an exhaust gas temperature in the vicinity of an exhaust port) is estimated based on the intake air amount, the rotational speed of the internal combustion engine, and the like. Incidentally, the exhaust gas temperature Tg may be detected by a temperature sensor. Further, an estimation exhaust pipe temperature Tp (for example, an exhaust pipe temperature in the vicinity of an exhaust gas sensor) is estimated by a method to be described later.

Further, a condensation ratio C corresponding to the current estimation exhaust gas temperature Tg and the estimation exhaust pipe temperature Tp is calculated with reference to a two-dimensional map of a condensation ratio C obtained in advance using the estimation exhaust gas temperature Tg and the estimation exhaust pipe temperature Tp as parameters. The condensation ratio C is a proportion that will be condensed in the exhaust pipe 27 out of water vapor (water vapor in the exhaust gas) generated by the combustion reaction between the fuel and the intake air.

The two-dimensional map of the condensation ratio C is created in advance using a relationship among the estimation exhaust gas temperature Tg, the estimation exhaust pipe temperature Tp, and the condensation ratio C, which are obtained based on experimental data, design data, and the like, and stored in the ROM of the control device ECU.

Thereafter, the condensation ratio C and a calculation cycle Δt are multiplied by the water vapor amount Mwgs to calculate a condensate water increase amount ΔMcon [g] per calculation cycle Δt as illustrated in the following Formula (1).

$$\Delta Mcon = Mwgs \times C \times \Delta t \quad (1)$$

Thereafter, the current condensate water increase amount ΔMcon is added to the condensate water amount estimation value Mcon obtained in the previous calculation to obtain the current condensate water amount estimation value Mcon [g] as illustrated in the following Formula (2).

$$Mcon = Mcon + \Delta Mcon \quad (2)$$

In this manner, it is necessary to accurately obtain an initial value of the estimation exhaust pipe temperature Tp at the time of restarting the exhaust pipe 27 in order to accurately obtain the condensate water amount estimation value Mcon.

The condensate water amount estimation value Mcon is stored in a backup RAM (storage means) of the control device ECU and is sequentially updated every calculation cycle Δt. The data stored in the backup RAM of the control device ECU is retained even during the stop of the internal combustion engine whose ignition switch (not illustrated) is turned off.

When the condensate water amount Mcon is estimated at the time of restarting the internal combustion engine, the condensate water amount estimation value Mcon stored immediately before the previous stop of the internal combustion engine (that is, an estimated value of the condensate water amount remaining in the exhaust pipe 27 during the stop of the internal combustion engine) is set as an initial value.

Meanwhile, when the intake air amount increases due to depression of an accelerator or the like and the amount of the exhaust gas flowing through the exhaust pipe 27 increases during the operation of the internal combustion engine, the condensate water accumulated in the exhaust pipe 27 is blown off by flow energy of the exhaust gas and discharged to the outside of the exhaust pipe 27.

Therefore, the condensate water amount estimation value Mcon is reset to "0" when an intake air amount Mair exceeds a predetermined value Mth in the present embodiment. Alternatively, the condensate water amount estimation value Mcon may be decreased depending on the intake air amount Mair. As a result, when the intake air amount Mair increases so that the amount of the exhaust gas flowing through the exhaust pipe 27 increases, it is possible to reset or reduce the condensate water amount estimation value Mcon to "0" in response to the state where the condensate water accumulated in the exhaust pipe 27 is blown off by the exhaust gas and discharged to the outside of the exhaust pipe 27.

Next, a method of estimating the estimation exhaust pipe temperature Tp for obtaining the above-described condensate water amount estimation value Mcon will be described.

Figure 6:
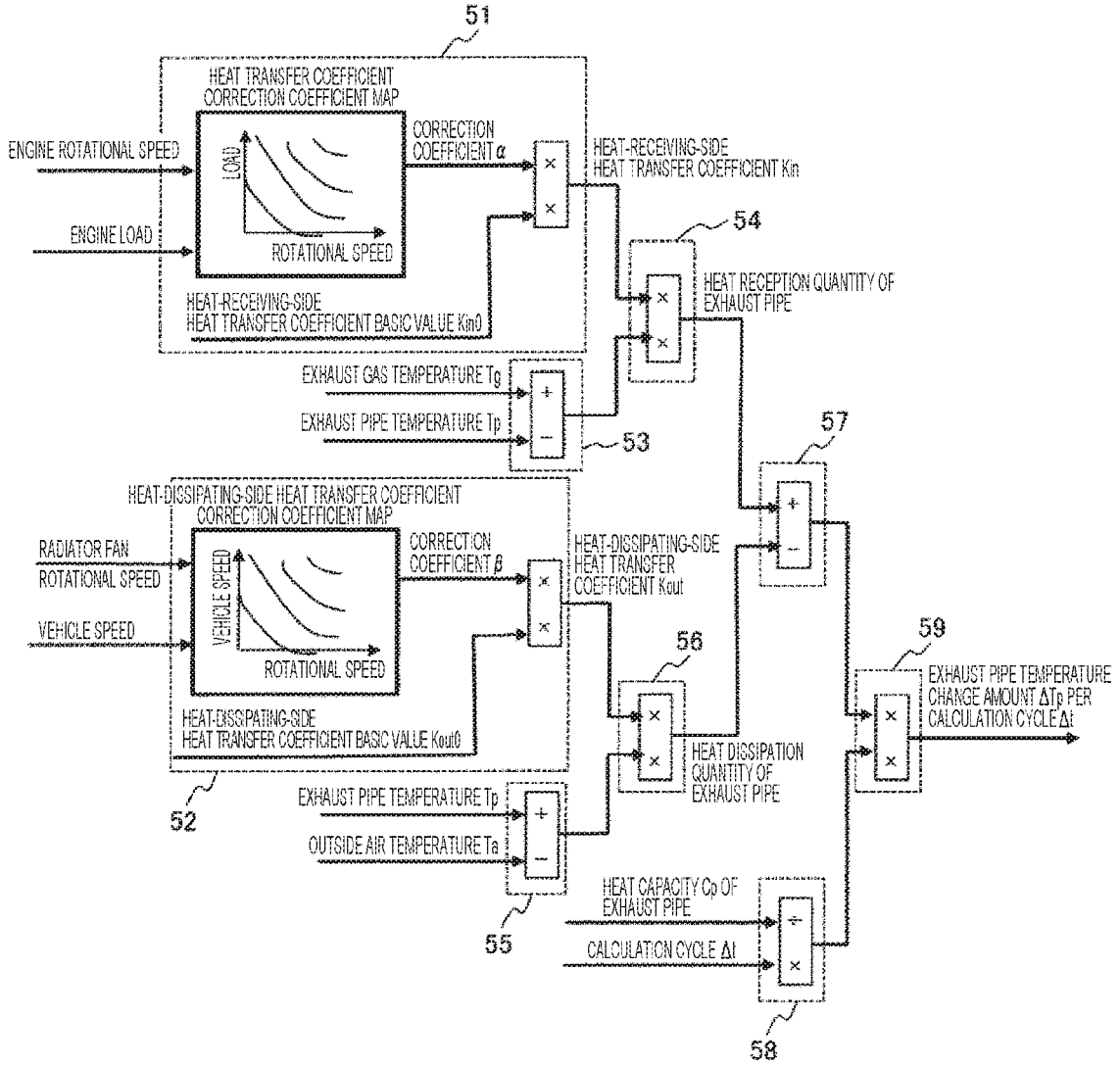
FIG. 6 is an explanatory diagram for describing an estimation method for estimating an exhaust pipe temperature when the internal combustion engine is operated.

During the operation of the internal combustion engine (a period from the start of the internal combustion engine to the turning-off of the ignition switch), the control device ECU estimates the estimation exhaust pipe temperature Tp based on the "exhaust temperature estimation function unit" illustrated in FIG. 6.

In the case of estimating the estimation exhaust pipe temperature Tp during the operation of the internal combustion engine as illustrated in FIG. 6, a heat-receiving-side heat transfer coefficient Kin to obtain a heat reception quantity that is transferred from the exhaust gas to the exhaust pipe 27 and a heat-dissipating-side heat transfer coefficient Kout to obtain a heat dissipation quantity that is dissipated from the exhaust pipe 27 to the outside air are calculated first.

When calculating the heat-receiving-side heat transfer coefficient Kin, a heat-receiving-side heat transfer coefficient calculation unit 51 refers to a map of a correction coefficient α having a rotational speed (substitute information of exhaust flow velocity) and a load (substitute information of exhaust pressure) of the internal combustion engine as parameters to calculate the correction coefficient α corresponding to the current rotational speed and load of the internal combustion engine. This correction coefficient α is a coefficient for correction of a heat-receiving-side heat transfer coefficient basic value Kin0.

The map of the correction coefficient α is created in advance by using a relationship among the rotational speed, the load, and the heat reception quantity of the exhaust pipe 27, which are obtained based on the experimental data, the design data, and the like, and stored in the ROM of the control device ECU. In general, the heat reception quantity of the exhaust pipe 27 decreases as the rotational speed increases so that the exhaust flow velocity increases, and the heat reception quantity of the exhaust pipe 27 increases as the load increases so that the exhaust pressure increases. Thus, the map of the correction coefficient α is set such that the correction coefficient α decreases and the heat-receiving-side heat transfer coefficient Kin decreases as the rotational speed increases, and the correction coefficient α increases and the heat-receiving-side heat transfer coefficient Kin increases as the load increases.

When the correction coefficient α is obtained, the heat-receiving-side heat transfer coefficient Kin is obtained by multiplying the heat-receiving-side heat transfer coefficient basic value Kin0 by the correction coefficient α in the following Formula (3).

$$Kin = Kin0 \times \alpha \tag{3}$$

As a result, it is possible to obtain the heat-receiving-side heat transfer coefficient Kin by correcting the heat-receiving-side heat transfer coefficient basic value Kin0 in response to the rotational speed (substitute information of the exhaust flow velocity) or the load (substitute information of the exhaust pressure) of the internal combustion engine.

In this manner, a difference (Tg−Tp) between the estimation exhaust gas temperature Tg and the estimation exhaust pipe temperature Tp is obtained by a heat-receiving-side temperature difference calculation unit 53 after calculating the heat-receiving-side heat transfer coefficient Kin, and a heat reception quantity calculation unit 54 multiplies the difference by the heat-receiving-side heat transfer coefficient Kin to obtain a heat reception quantity {Kin×(Tg−Tp)} of the exhaust pipe 27. Here, the exhaust gas temperature Tg and the exhaust pipe temperature Tp are obtained by performing estimation with a predetermined calculation cycle, and the estimation exhaust gas temperature Tg and the estimation exhaust pipe temperature Tp which have been estimated previously are used.

On the other hand, when calculating the heat-dissipating-side heat transfer coefficient Kout, a heat-dissipating-side heat transfer coefficient calculation unit 52 refers to a map of a correction coefficient β having a radiator fan rotational speed and a vehicle speed as parameters to calculate the correction coefficient β corresponding to the current radiator fan rotational speed and vehicle speed. This correction coefficient β is a coefficient for correction of a heat-dissipating-side heat transfer coefficient basic value Kout0.

The map of the correction coefficient β is created in advance by using a relationship among the radiator fan rotational speed, the vehicle speed, and the heat dissipation quantity of the exhaust pipe 27, which are obtained based on the experimental data, the design data, and the like, and stored in the ROM of the control device ECU. In general, the heat dissipation quantity of the exhaust pipe 27 increases as the radiator fan rotational speed or the vehicle speed increases, and thus, the map of correction coefficient β is set such that the correction coefficient β increases so that the heat-dissipating-side heat transfer coefficient Kout increases as the radiator fan rotational speed or the vehicle speed becomes higher.

Incidentally, the heat dissipation quantity of the exhaust pipe 27 increases as an atmospheric pressure (pressure outside the exhaust pipe 27) increases, and thus, the map may be set such that the correction coefficient β increases so that the heat-dissipating-side heat transfer coefficient Kout may increase as the atmospheric pressure increases.

Thereafter, when the correction coefficient β is obtained, the heat-dissipating-side heat transfer coefficient Kout is obtained by multiplying the heat-dissipating-side heat transfer coefficient basic value Kout0 by the correction coefficient β in the following Formula (4).

$$Kout = Kout0 \times \beta \tag{4}$$

As a result, it is possible to obtain the heat-dissipating-side heat transfer coefficient Kout by correcting the heat-dissipating-side heat transfer coefficient basic value Kout0 in response to the radiator fan rotational speed or the vehicle speed.

In this manner, a difference (Tp−Ta) between the estimation exhaust pipe temperature Tp and an outside air temperature Ta is obtained by a heat-dissipating-side temperature difference calculation unit 55 after calculating the heat-dissipating-side heat transfer coefficient Kout, and a heat dissipation quantity calculation unit 56 multiplies the difference by the heat-dissipating-side heat transfer coefficient Kout to obtain a heat dissipation quantity {Kout×(Tp−Ta)} of the exhaust pipe 27. Even in this case, the estimation exhaust pipe temperature Tp is estimated with a predetermined calculation cycle, and the exhaust pipe temperature Tp which has been estimated previously is used.

Next, a "heat quantity difference calculation unit" 57 obtains a heat quantity difference between the heat reception quantity {Kin×(Tg−Tp)} of the exhaust pipe 27 and the heat dissipation quantity {Kout×(Tp−Ta)} of the exhaust pipe 27, a "heat capacity calculating unit" 58 obtains a heat capacity Cp of the exhaust pipe 27, and an "exhaust pipe temperature change amount calculation unit" 59 calculates an exhaust pipe temperature change amount ΔTp per calculation cycle Δt by the following Formula (5) using the calculation cycle Δt.

$$\Delta Tp = \{Kin \times (Tg - Tp) - Kout \times (Tp - Ta)\} / Cp \times \Delta t \tag{5}$$

Thereafter, a current estimation exhaust pipe temperature estimated value Tp is obtained by adding the current exhaust pipe temperature change amount ΔTp to the previous estimation exhaust pipe temperature estimated value Tp by the following Formula (6).

$$Tp=Tp+\Delta Tp \quad (6)$$

This estimation exhaust pipe temperature estimated value Tp is stored in the backup RAM of the control device ECU and used at the next restart.

However, the control device ECU stops during the stop of the internal combustion engine, and thus, it is difficult to calculate the heat balance as described above. Thus, the actual exhaust pipe temperature is changing from the stop of the internal combustion engine to the restart, and the restart-time estimation exhaust pipe temperature Tp*, which is the initial value when the internal combustion engine is restarted, is inaccurate.

Thus, in the related art, the estimation exhaust pipe temperature at the next restart is estimated by correcting the estimation exhaust pipe temperature during the stop of the internal combustion engine based on the change amount in the coolant temperature when the internal combustion engine is stopped and the operation of the sensor heater is started assuming that the condensate water has evaporated when the exhaust pipe temperature is higher than the predetermined value.

However, this method does not respond to the change of the environmental condition relating to the internal combustion engine during the stop and the estimation accuracy is low. Therefore, the method of accurately estimating the internal temperature of the exhaust pipe 27 at restart after the stop of the internal combustion engine is proposed in the present embodiment.

In the present embodiment, first correction information based on changes of an exhaust pipe temperature and an elapsed time at stop, second correction information based on a change of an internal combustion engine temperature at the stop of the internal combustion engine, and third correction information based on a change of a cooling degree due to outdoor air during the stop from the stop to restart are obtained, and a stop-time estimation exhaust pipe temperature at the time of stop is corrected using at least one correction information among these pieces of correction information to obtain the restart-time estimation exhaust pipe temperature (initial value) Tp* at the time of restart. Hereinafter, the first correction information to the third correction information will be described.

<<First Correction Information>>

First, the first correction information based on the changes of the exhaust pipe temperature and the elapsed time at stop will be described. In the present embodiment, a correction coefficient is set as the first correction information.

Figure 7:
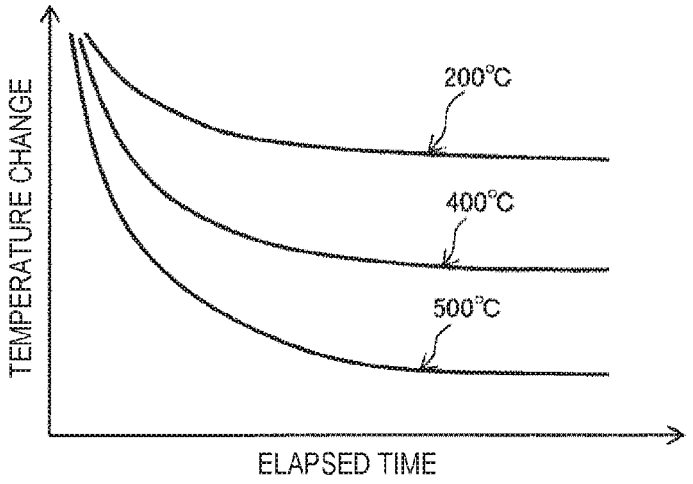
FIG. 7 is a characteristic graph for describing a difference in temperature change caused by the exhaust pipe temperature when the internal combustion engine is stopped.
Figure 8:
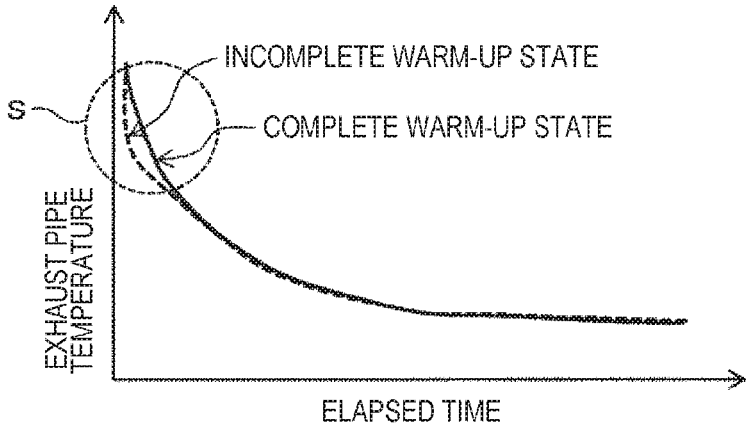
FIG. 8 is a characteristic graph for describing a change in exhaust pipe temperature caused by a difference of a warm-up state when the internal combustion engine is stopped.

As illustrated in FIG. 7, it has been found that a temperature decrease amount with respect to the elapsed time varies depending on an exhaust pipe temperature at stop (immediately after the stop) of the internal combustion engine. A temperature change amount in a case when the exhaust pipe temperature is 400° C. is larger than a temperature change amount in a case when the exhaust pipe temperature is 200° C. within a same time interval. Similarly, a temperature change amount in a case when the exhaust pipe temperature is 500° C. more greatly changes. Therefore, if the time from the stop of the internal combustion engine to the restart is the same, the temperature decrease amount becomes larger as a stop-time estimation exhaust pipe temperature Tpend at the time of stop is higher.

Therefore, it is necessary to set the first correction information for each preset stop-time estimation exhaust pipe temperature, and to correct and obtain the restart-time estimation exhaust pipe temperature Tp* at the time of restart based on the first correction information corresponding to this stop-time estimation exhaust pipe temperature Tpend at the time of stop.

Thus, it is possible to correct the restart-time estimation exhaust pipe temperature Tp* at the time of restart by setting an exhaust pipe temperature decrease coefficient Tx ("1.00" to "0.00") in response to an elapsed time since the stop for each preset estimation exhaust pipe temperature at the stop of the internal combustion engine, and reflecting the exhaust pipe temperature decrease coefficient Tx to the stop-time estimation exhaust pipe temperature Tpend at the time of stop of the internal combustion engine. The exhaust pipe temperature decrease coefficient Tx is stored in advance in the ROM of the control device ECU as an "exhaust pipe temperature estimation reference map" created by using a relationship between the exhaust pipe temperature and the elapsed time obtained based on experimental data, design data, and the like.

Here, the exhaust pipe temperature decrease coefficient Tx is set such that a condition for starting the heating operation of the sensor heater 47 of the exhaust gas sensor 28 when the internal combustion engine is restarted is satisfied relatively late as the elapsed time from the stop to the restart increases. That is, the exhaust pipe temperature decrease coefficient Tx is smaller as the elapsed time is longer, and the restart-time estimation exhaust pipe temperature Tp* at the time of restart is set to be lower. Here, an effective digit number of the exhaust pipe temperature decrease coefficient Tx is arbitrary.

Incidentally, a basic estimation exhaust pipe temperature Tpbase at the time of restart is obtained by multiplying the stop-time estimation exhaust pipe temperature Tpend at the time of stop by the exhaust pipe temperature decrease coefficient Tx in the present embodiment. The second correction information and the third correction information to be illustrated hereinafter are reflected to the basic estimation exhaust pipe temperature Tpbase.

<<Second Correction Information>>

Next, the second correction information based on the change of the internal combustion engine temperature at stop (immediately after the stop) of the internal combustion engine will be described. In the present embodiment, a correction coefficient is set as the second correction information.

It has been found that the transition of the change of the exhaust pipe temperature is affected by whether the warm-up has been completed or the warm-up has not been completed yet as the own temperature change of the internal combustion engine. For example, if a state where a coolant temperature at the stop of the internal combustion engine is 80 degrees or higher is set as a complete warm-up state, a state where the coolant temperature at the stop of the internal combustion engine is below 80 degrees is set as an incomplete warm-up state. As indicated by a broken-line circle S in FIG. 8, it has been found that a decrease amount of the exhaust pipe temperature within a predetermined time immediately after the stop is remarkably large when the internal combustion engine is in the incomplete warm-up state immediately after the stop as compared with the case where the exhaust pipe temperature is in the complete warm-up state even if the exhaust pipe temperature Tpend at the time of stop of the internal combustion engine is the same.

Therefore, the present embodiment has been made to consider the own temperature state of the internal combustion engine after the stop of the internal combustion engine, and then, correct and estimate the exhaust pipe temperature Tp* at the time of restart of the internal combustion engine. Incidentally, the coolant temperature is used as an index representing the temperature state of the internal combustion engine in the present embodiment.

A reason why the own temperature state of the internal combustion engine is taken into consideration in this manner is that the transition of the exhaust pipe temperature during the stop of the internal combustion engine is greatly affected by a temperature of a peripheral space of the exhaust pipe 27. That is, the temperature of the peripheral space of the exhaust pipe 27 is represented by a temperature in an engine room of an automobile, and further, a heat source that greatly affects the temperature inside the engine room is the own temperature of the internal combustion engine.

Therefore, the own temperature of the internal combustion engine is low in the incomplete warm-up state at the time of stop (immediately after stop) of the internal combustion engine, and thus, the temperature of the peripheral space of the exhaust pipe 27 also becomes low so that the heat dissipation amount during the stop of the internal combustion engine increases and the exhaust pipe temperature decreases relatively early. On the other hand, the own temperature of the internal combustion engine is high in the complete warm-up state, the temperature of the peripheral space of the exhaust pipe 27 also becomes high so that the heat dissipation amount during the stop of the internal combustion engine is small, and thus, the decrease of the exhaust pipe temperature becomes relatively late.

Thus, it is possible to correct the restart-time estimation exhaust pipe temperature Tp* at the time of restart by determining the complete warm-up state or the incomplete warm-up state based on the coolant temperature at the time of stop of the internal combustion engine, setting a warm-up heat dissipation coefficient Ty ("1.00" to "0.00") in response to each coolant temperature, and reflecting the warm-up heat dissipation coefficient Ty to the stop-time estimation exhaust pipe temperature Tpend at the time of stop of the internal combustion engine. The warm-up heat dissipation coefficient Ty is stored in advance in the ROM of the control device ECU as a "warm-up heat dissipation correction table" created by using a relationship with the coolant temperature obtained based on experimental data, design data, and the like.

Here, the basic estimation exhaust pipe temperature Tpbase is corrected by multiplying the above-described basic estimation exhaust pipe temperature Tpbase at the time of restart by the warm-up heat dissipation coefficient Ty in the present embodiment. Incidentally, the warm-up heat dissipation coefficient Ty may be changed in response to the elapsed time. In this case, the warm-up heat dissipation coefficient Ty may be stored in advance in the ROM of the control device ECU as a map created by using a relationship between the coolant temperature and the elapsed time obtained based on experimental data, design data, and the like.

Here, the warm-up heat dissipation coefficient Ty is set such that a condition for starting the heating operation of the sensor heater 47 of the exhaust gas sensor 28 when the internal combustion engine is restarted is satisfied relatively later as the coolant temperature is lower. In other words, as the coolant temperature is lower, the warm-up heat dissipation coefficient Ty is smaller, and the restart-time estimation exhaust pipe temperature Tp* becomes lower. An effective digit number of this warm-up heat dissipation coefficient Ty is arbitrary.

Incidentally, an example in which the temperature inside the engine room is substituted by the coolant temperature of the internal combustion engine has been illustrated in the present embodiment, but an oil temperature of a lubricating oil can also be used. Further, when an engine room temperature sensor is provided, it is possible to obtain the warm-up heat dissipation coefficient Ty using the engine room temperature sensor.

<<Third Correction Information>>

Next, the third correction information based on the change of the cooling degree due to the outdoor air during stop from the stop to restart will be described. In the present embodiment, a correction coefficient is set as the third correction information.

Figure 9:
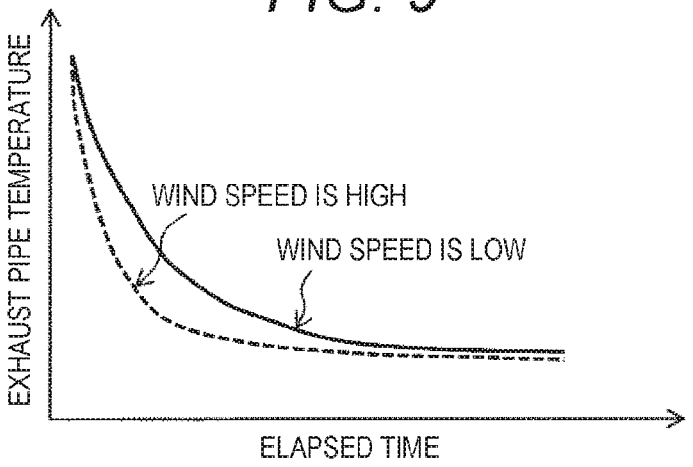
FIG. 9 is a characteristic graph for describing a change in exhaust pipe temperature caused by a difference of wind speed when the internal combustion engine is stopped.

It has been also found that the transition of the exhaust pipe temperature during the stop of the internal combustion engine is affected by a state of the outside air in addition to the above-described change factors. When wind is blowing during the stop of the internal combustion engine, a heat quantity taken away from the exhaust pipe 27 is larger if the wind speed is higher than when the wind speed is low, and the exhaust pipe temperature decreases early as illustrated in FIG. 9. Therefore, the exhaust pipe temperature at the time of restart also fluctuates depending on the magnitude of the wind speed. Thus, it is necessary to correct a restart-time estimation exhaust gas temperature Tp* at the time of restart in response to the magnitude of the wind speed.

However, it is difficult to measure the wind speed, and thus, it is possible to estimate which level of the wind speed is by determining how much a temperature difference between a coolant temperature at the stop and a coolant temperature at the restart has changed within a predetermined set time. In the present embodiment, the coolant temperature at the stop of the internal combustion engine and the coolant temperature at the restart are compared, and it is determined that a cooling effect by the wind has the influence when such a temperature difference occurs within the set time.

Therefore, it is possible to correct the restart-time estimation exhaust pipe temperature Tp* at the restart by setting a cooling coefficient Tz, set by a temperature change amount and a stop time of the internal combustion engine, and reflecting the cooling coefficient Tz ("1.00" to "0.00") to the stop-time estimation exhaust pipe temperature Tpend at the stop of the internal combustion engine. The cooling coefficient Tz is stored in advance in the ROM of the control device ECU as a "wind-based cooling correction map" created by using a relationship between a change amount of the coolant temperature and the elapsed time obtained based on experimental data, design data, and the like. Incidentally, it is also possible to reflect the temperature of the outside air. In this case, it is preferable to set a value of the cooling coefficient Tz to be smaller as the outside air temperature is lower.

Here, the cooling coefficient Tz is set such that a condition for starting the heating operation of the sensor heater 47 of the exhaust gas sensor 28 when the internal combustion engine is restarted is satisfied relatively late as a temperature change amount in a predetermined elapsed time is larger. In other words, as the temperature change amount increases in a certain elapsed time, the cooling coefficient Tz decreases, and the restart-time estimation exhaust pipe temperature Tp* at the restart decreases. In the present embodiment, a plurality of temperature change amounts is set for each time zone, and the cooling coefficient Tz is allocated thereto. A plurality of the time zones is set, and a time zone is selected in response to the elapsed time. An effective digit number of this cooling coefficient Tz is arbitrary.

Further, the restart-time estimation exhaust pipe temperature Tp* at the restart is corrected by multiplying the basic estimation exhaust pipe temperature Tpbase by the cooling coefficient Tz in the present embodiment.

Figure 10:
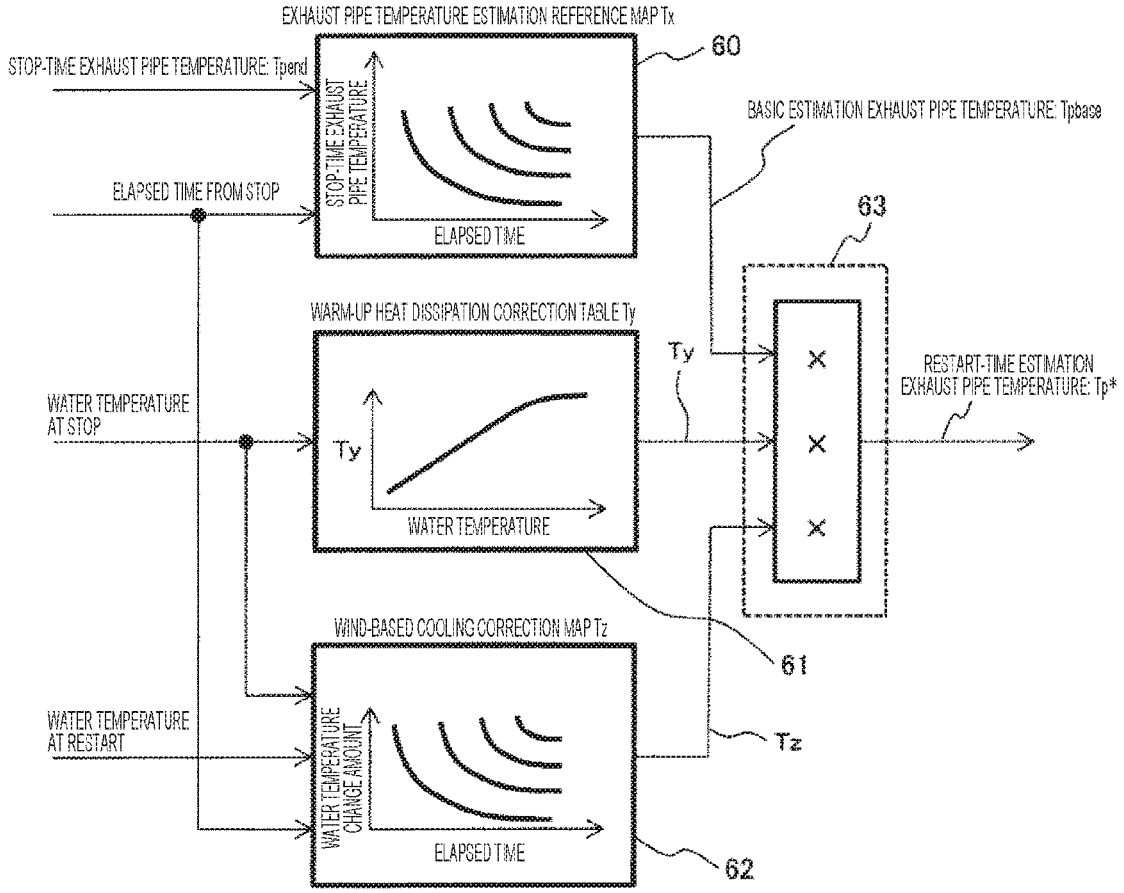
FIG. 10 is an explanatory diagram for describing an estimation method for estimating a restart-time estimation exhaust pipe temperature according to an embodiment of the present invention.

The correction information obtained as above is combined by a logic as illustrated in FIG. 10 to obtain the restart-time estimation exhaust pipe temperature Tp* at the time of restart. In FIG. 10, when the restart-time estimation exhaust pipe temperature Tp* is estimated at the time of performing restart from the stop state of the internal combustion engine, the exhaust pipe temperature decrease coefficient Tx, the warm-up heat dissipation coefficient Ty, and the cooling coefficient Tz, which are the above-described correction information, are obtained.

The exhaust pipe temperature decrease coefficient Tx is read from an exhaust pipe temperature estimation reference map 60 based on the stop-time estimation exhaust pipe temperature Tpend at the stop and the elapsed time after the stop obtained as in FIG. 6, the stop-time estimation exhaust pipe temperature Tpend at the stop is multiplied by the exhaust pipe temperature decrease coefficient Tx as in the following Formula (7) to obtain the basic estimation exhaust pipe temperature Tpbase at the restart.

$$Tp\text{base}=Tp\text{end}\times Tx \tag{7}$$

Next, the warm-up heat dissipation coefficient Ty is read out from a warm-up heat dissipation correction table 61 by the coolant temperature at the stop (desirably, immediately after stop). Similarly, the cooling coefficient Tz is read out from a cooling correction map 62 based on the temperature difference between the coolant temperature at the stop and the coolant temperature at the restart and the elapsed time.

Then, a restart-time estimation exhaust pipe temperature calculation unit 63 multiplies the basic estimation exhaust pipe temperature Tpbase at the restart by the warm-up heat dissipation coefficient Ty and the cooling coefficient Tz as in the following Formula (8) to obtain the restart-time estimation exhaust pipe temperature Tp* at the restart.

$$Tp=Tp\text{base}\times Ty\times Tz \tag{8}$$

With the above calculation, it is possible to accurately estimate the restart-time estimation exhaust pipe temperature Tp* at the restart of the internal combustion engine. The restart-time estimation exhaust pipe temperature Tp* at the restart is used to calculate the estimation exhaust pipe temperature Tp during the operation by the estimation method illustrated in FIG. 6 along with the progress of the operation state of the internal combustion engine thereafter. In this manner, since the restart-time estimation exhaust pipe temperature Tp* at the restart is accurately estimated, the erroneous estimation on the amount of condensate water is avoided and a start timing of the heating operation of the exhaust gas sensor is optimized.

Figure 11:
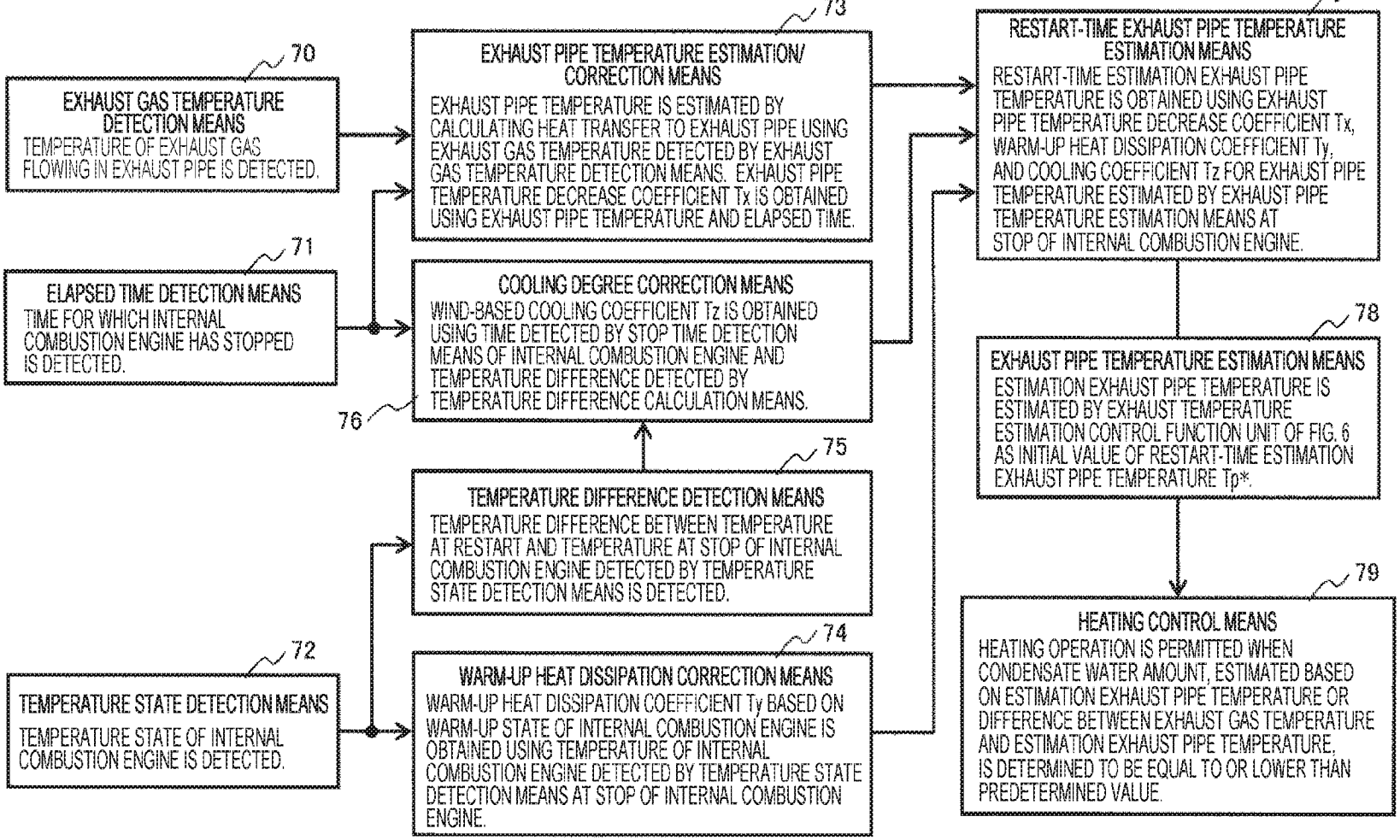
FIG. 11 is a configuration diagram illustrating a functional block according to an embodiment of the present invention.

Next, a basic constitutional requirement for obtaining the restart-time estimation exhaust pipe temperature Tp* at the time of restart will be described. FIG. 11 illustrates a basic functional block.

In FIG. 11, a reference sign 70 denotes an exhaust gas temperature detection means for estimating a temperature of an exhaust gas flowing in the exhaust pipe that obtains the exhaust gas temperature based on the intake air amount, the rotational speed, and the like as described above. Incidentally, it is also possible to obtain the exhaust gas temperature using a temperature sensor.

In addition, a reference sign 71 denotes a time detection means for detecting the elapsed time since stop of the internal combustion engine, and the elapsed time can be detected by using a timer function built in the control device ECU. In addition, a reference sign 72 denotes a temperature state detection means for detecting an own temperature state of the internal combustion engine, and a water temperature sensor that detects the coolant temperature can be used.

A reference sign 73 denotes an exhaust pipe temperature estimation/correction means that has a function of calculating a heat transfer from the exhaust gas temperature detected by the exhaust gas temperature detection means to the exhaust pipe and estimating the exhaust pipe temperature. The elapsed time from the time detection means 71 is input to the exhaust pipe temperature estimation/correction means 73, and the exhaust pipe temperature decrease coefficient Tx is obtained. Incidentally, the basic estimation exhaust pipe temperature Tpbase at the restart is obtained by the exhaust pipe temperature estimation/correction means 73 in FIG. 10, but is obtained by a restart-time exhaust pipe temperature estimation means 77 to be described below in FIG. 11.

A reference sign 74 denotes a warm-up correction means that has a function of determining a warm-up state of the internal combustion engine based on the coolant temperature detected by the temperature state detection means 72 of the internal combustion engine at the stop (desirably, immediately after stop) of the internal combustion engine and obtaining the warm-up heat dissipation coefficient Ty.

In addition, a reference sign 75 denotes a temperature difference detection means for detecting the temperature difference between the coolant temperature at the stop of the internal combustion engine and the coolant temperature at the restart detected by the temperature state detection means 72. This serves as one parameter to obtain the cooling coefficient Tz caused by a difference in wind speed.

Further, a reference sign 76 denotes a cooling degree detection means that has a function of obtaining the cooling coefficient Tz by obtaining a cooling effect using wind based on the elapsed time detected by the time detection means and the temperature difference detected by the temperature difference calculation means.

A reference sign 77 denotes a restart-time exhaust pipe temperature estimation means, and the exhaust pipe temperature decrease coefficient Tx, the warm-up heat dissipation coefficient Ty, and the cooling coefficient Tz described above of the restart-time exhaust pipe temperature estimation means 77 are input. The restart-time exhaust pipe temperature estimation means 77 performs calculation of Tp*=Tpend×Tx×Ty×Tz to estimate the restart-time estimation exhaust pipe temperature Tp* at the restart of the internal combustion engine.

A reference sign 78 denotes an exhaust pipe temperature estimation means to which the restart-time estimation exhaust pipe temperature Tp* at the restart is input, an exhaust temperature estimation control function unit illustrated in FIG. 6 estimates the current estimation exhaust pipe temperature Tp using the exhaust pipe temperature restart-time estimation exhaust pipe temperature Tp* as an initial value. Therefore, since the exhaust pipe temperature estimation means 78 has the same function as a part of the exhaust pipe temperature estimation/correction means 73, it is also possible to share the exhaust pipe temperature estimation means 78 and the exhaust pipe temperature estimation/correction means 73.

A reference sign 79 is a heating control means, and the current estimation exhaust pipe temperature Tp is input to the heating control means 78. The heating control means 79 performs control to permit the heating operation of the sensor heater when it is determined that the amount of condensate water estimated based on the estimation exhaust pipe temperature Tp, or the difference between the exhaust gas temperature Tg and the estimation exhaust pipe temperature Tp is equal to or smaller than a predetermined value.

Incidentally, the condensate water estimation is performed by the heating control means 79 in the present embodiment, but it is also possible to control a start operation of the sensor heater only with the estimation exhaust pipe temperature Tp without the condensate water estimation.

In this manner, in the present embodiment, the first correction information (Tx) based on the change of the exhaust pipe temperature and the elapsed time at the stop of the internal combustion engine, the second correction information (Ty) based on the change of the internal combustion engine temperature at the stop, and the third correction information (Tz) based on the change of the cooling degree due to outdoor air during stop from the stop to restart are obtained, the stop-time estimation exhaust pipe temperature at the stop is corrected using at least one or more pieces of the correction information at restart of the internal combustion engine to estimate the restart-time estimation exhaust pipe temperature Tp* at the restart, and the estimation exhaust pipe temperature Tp during an operation of the internal combustion engine thereafter is obtained using the restart-time estimation exhaust pipe temperature Tp* as the initial value, and further, the heating operation of the sensor heater is started when the estimation exhaust pipe temperature Tp becomes equal to or higher than the predetermined value. As a result, it is possible to properly heat the exhaust gas sensor and activate the exhaust gas sensor at an early stage while suppressing damage of the sensor element of the exhaust gas sensor.

Here, the functional block illustrated in FIG. 11 is actually executed by a control program of a microcomputer of the control device ECU, and control flow thereof will be described hereinafter with reference to FIG. 12.

Figure 12:
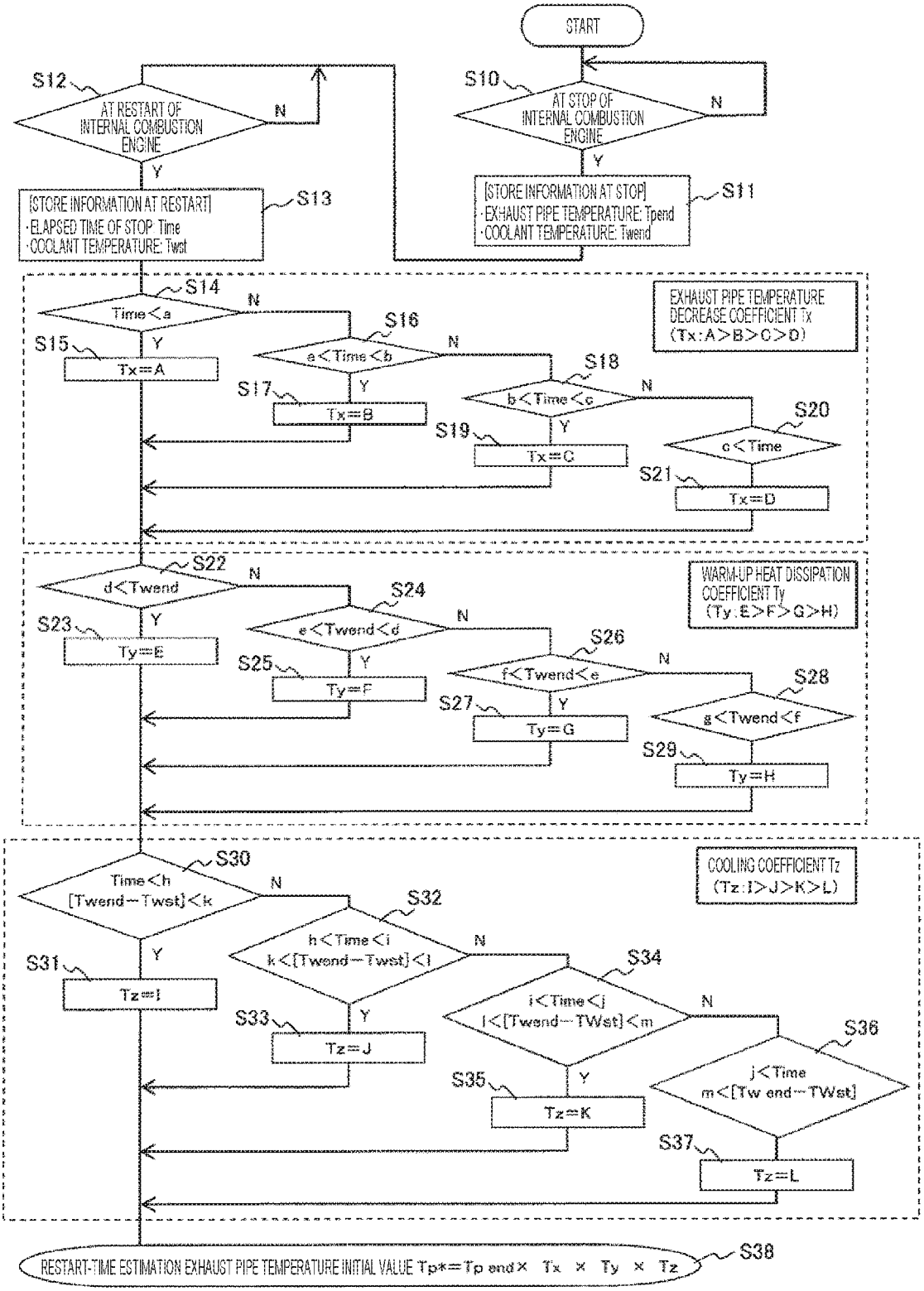
FIG. 12 is a flowchart illustrating a control flow for executing the functional block illustrated in FIG. 11.

Incidentally, the control flow in FIG. 12 illustrates flow until obtaining the restart-time estimation exhaust pipe temperature Tp* at the restart, and the subsequent heating start operation of the sensor heater is omitted since various methods can be carried out. For example, a heating start operation can control the start operation of the sensor heater with the condensate water estimate and the estimation exhaust pipe temperature Tp.

The control flow in FIG. 12 is started every predetermined time interval, for example, is started every 10 ms in the present embodiment. Such a start timing can use compare match interrupt with an internal timer.

In step S10, it is determined whether the internal combustion engine has been stopped. If the internal combustion engine has not been stopped, step S10 is repeated. On the other hand, if it is determined in step S10 that the internal combustion engine has stopped, the processing proceeds to step S11 to store information at the stop. In this case, at least the stop-time estimation exhaust pipe temperature Tpend and a coolant temperature Twend at the stop are stored. These pieces of information are stored in the RAM area of the control device ECU. In addition, the internal timer starts to measure the elapsed time from the stop in synchronization with this stop determination. When this control step is ended, the processing proceeds to the next step S12.

In step S12, it is determined whether the internal combustion engine has been restarted. If the internal combustion engine has not been restarted, step S12 is repeated. On the other hand, if it is determined in step S12 that the internal combustion engine has been restarted, the processing proceeds to step S13 to store the information at the restart. In this case, at least an elapsed time Time since the stop, measured by the internal timer, and a coolant temperature Twst at the restart are stored. Incidentally, the estimation exhaust pipe temperature Tp during the stop is hardly estimated because the internal combustion engine is stopped, and is not updated or stored. When this control step is ended, the processing proceeds to the next step S14.

Steps S14 to S21 are control steps to obtain the exhaust pipe temperature decrease coefficient Tx which is the above-described first correction information. Steps S14, S16, S18, and S20 determine any stop time zone at which the elapsed time Time is present in relation to a predetermined stop time zone set in advance.

It is determined whether the elapsed time Time is in a time zone of [0 to a] in step S14, it is determined whether the elapsed time Time is in a time zone of [a to b] in step S16, it is determined whether the elapsed time Time is in a time zone of [b to c] in step S18, and it is determined whether the elapsed time Time is in a time zone of [c to] in step S20. Here, the stop time zones have a relationship of [0 to a]<[a to b]<[b to c]<[c to].

Further, the exhaust pipe temperature decrease coefficient Tx is set to A in step S15 if the elapsed time Time is in the time zone of [0 to a], the exhaust pipe temperature decrease coefficient Tx is set to B in step S17 if the elapsed time Time is in the time zone of [a to b], the exhaust pipe temperature decrease coefficient Tx is set to C in step S19 if the elapsed time Time is in the time zone of [b to c], and the exhaust pipe temperature decrease coefficient Tx is set to D in step S21 if the elapsed time Time is in the time zone of [c to].

Here, the exhaust pipe temperature decrease coefficients Tx have a relationship of A>B>C>D, and is set to a value closer to "1.00" as the stop time is shorter. Therefore, the restart-time estimation exhaust pipe temperature Tp* at the restart becomes closer to the stop-time estimation exhaust pipe temperature Tpend at the stop as the stop time is shorter. When the control steps to obtain the exhaust pipe temperature decrease coefficient Tx are ended, the processing proceeds to step S22.

Steps S22 to S28 are control steps to obtain the warm-up heat dissipation coefficient Ty which is the above-described second correction information. Steps S22, S24, S26, and S28 determine any degree of a warm-up state based on the coolant temperature Twend immediately after the stop. That is, it is determined any temperature zone where the coolant temperature Twend at the stop is present in relation to a predetermined temperature zone set in advance.

It is determined whether the coolant temperature Twend is in a temperature range of [d to] in step S22, it is determined whether the coolant temperature Twend is in a temperature range of [e to d] in step S24, it is determined whether the coolant temperature Twend is in a temperature range of [f to e] in step S26, and it is determined whether the coolant temperature Twend is in a temperature range of [g to f] in step S28. Here, the temperature zones have a relationship of [d to]>[e to d]>[f to e]>[g to f].

Further, the warm-up heat dissipation coefficient Ty is set to E in step S23 if the coolant temperature Twend is in the temperature range of [d to], the warm-up heat dissipation coefficient Ty is set to F in step S25 if the coolant temperature Twend is in the temperature range of [e to d], the warm-up heat dissipation coefficient Ty is set to G at step S27 if the coolant temperature Twend is in the temperature range of [f to e], and the warm-up heat dissipation coefficient Ty is set to H in step S29 if the coolant temperature Twend is in the temperature range of [g to f].

Here, the warm-up heat dissipation coefficients Ty have a relationship of E>F>G>H, and are set to a value closer to "1.00" as the coolant temperature is higher. Therefore, the restart-time estimation exhaust pipe temperature Tp* at the restart becomes closer to the stop-time estimation exhaust pipe temperature Tpend at the stop as the coolant temperature is higher. When the control steps to obtain the warm-up heat dissipation coefficient Ty are ended, the processing proceeds to step S30.

Steps S30 to S36 are control steps to obtain the cooling coefficient Tz which is the above-described third correction information. Steps S30, S32, S34, and S36 determine whether the elapsed time Time is within a predetermined elapsed time zone, and any temperature difference zone where the temperature difference between the coolant temperature at the stop and the coolant temperature at the restart is present. That is, an intersection between the elapsed time zone and the temperature difference zone is determined.

It is determined in step S30 that the elapsed time Time is in an elapsed time zone of [0 to h] and the temperature difference is in a temperature difference zone [0 to k], it is determined in step S32 that the elapsed time Time is in an elapsed time zone of [h to i] and the temperature difference is in a temperature difference zone [k to l], it is determined in step S34 that the elapsed time Time is in an elapsed time zone of [i to j] and the temperature difference is in a temperature difference zone [l to m], and it is determined in step S36 that the elapsed time Time is in an elapsed time zone of [j to] and the temperature difference is in a temperature difference zone [m to].

In this manner, steps S30, S32, S34, and S36 determine any temperature zone out of the plurality of temperature difference zones where the temperature difference of the coolant temperature changed within the elapsed time zone in which the elapsed time Time exists is present. Here, the elapsed time zones have a relationship of [0 to h]<[h to i]<[i to j]<[j to]. In addition, the temperature difference zones have a relationship of [0 to k]<[k to l]<[l to m]<[m to]. Therefore, for example, the temperature difference zones [0 to k], [k to l], [l to m], and [m to] are prepared with respect to the elapsed time zone [0 to h], and one temperature zone is selected out of the plurality of temperature zones. Incidentally, the same description applies to the other elapsed time zones.

Then, if it is determined in step S30 that the elapsed time Time is in the elapsed time zone of [0 to h] and the temperature difference is in the temperature difference zone [0 to k], the cooling coefficient Tz is set to I in step S31. If it is determined in step S32 that the elapsed time Time is in the elapsed time zone of [h to i] and the temperature difference is in the temperature difference zone [k to l], the cooling coefficient Tz is set to J in step S33. If it is determined in step S34 that the elapsed time Time is in the elapsed time zone of [i to j] and the temperature difference is in the temperature difference zone [l to m], the cooling coefficient Tz is set to K in step S35. If it is determined in step S36 that the elapsed time Time is in the elapsed time zone of [j to] and the temperature difference is in the temperature difference zone [m to], the cooling coefficient Tz is set to L in step S37.

Here, the cooling coefficients Tz have a relationship of I>J>K>L, and are set to a value closer to "1.00" as the temperature difference is smaller if the elapsed time is the same. Therefore, the restart-time estimation exhaust pipe temperature Tp* at the restart becomes closer to the stop-time estimation exhaust pipe temperature Tpend at the stop as the temperature difference is smaller. When the control steps to obtain the cooling coefficient Tz are ended, the processing proceeds to step S38.

In step S38, in order to reflect the exhaust pipe temperature decrease coefficient Tx, the warm-up heat dissipation coefficient Ty, and the cooling coefficient Tz to the stop-time estimation exhaust pipe temperature Tpend obtained at the stop, the calculation of Tp*=Tpend×Tx×Ty×Tz is executed to estimate the restart-time estimation exhaust pipe temperature Tp* at the restart of the internal combustion engine.

As described above, in the present embodiment, it is configured to obtain the first correction information based on the change of the exhaust pipe temperature and the elapsed time at the stop, the second correction information based on the change of the internal combustion engine temperature at the stop of the internal combustion engine, and the third correction information based on the change of the cooling degree due to outdoor air during stop from the stop to restart, to correct the stop-time estimation exhaust pipe temperature at the stop using at least one or more pieces of the correction information at restart of the internal combustion engine to estimate the restart-time estimation exhaust pipe temperature at the restart, and to obtain the estimation exhaust pipe temperature during the operation of the internal combustion engine thereafter using the restart-time estimation exhaust pipe temperature as the initial value, and further, to start the heating operation of the sensor heater when the estimation exhaust pipe temperature becomes equal to or higher than the predetermined value. As a result, it is possible to properly heat the exhaust gas sensor and activate the exhaust gas sensor at an early stage while suppressing damage of the sensor element of the exhaust gas sensor.

The above description has been made as countermeasures for the prevention of damage of the sensor element of the exhaust gas sensor and the reduction of the emission amount of harmful components of the exhaust gas. Meanwhile, the above-described exhaust pipe temperature estimation can also be applied to catalyst temperature estimation control for activity determination of an exhaust gas purification catalyst.

The exhaust gas is not purified before activation of the exhaust gas purification catalyst, and the emission amount of harmful components of the exhaust gas increases. Thus, a technique by which immediately after starting the internal combustion engine, the ignition timing is retarded and the intake air amount is increased to generate the thermal reactor effect and to activate the exhaust gas purification catalyst at an early stage is well known.

However, retardation of an ignition timing and increase of the intake air amount lead to deterioration in combustion of the internal combustion engine and increase of the emission amount of harmful gas components, and thus, it is required to accurately determine an activation timing of the exhaust gas purification catalyst and immediately return to normal ignition timing and intake air amount after the catalyst activity.

Therefore, catalyst temperature estimation and catalytic activity determination are performed by various methods. In the case of stopping the internal combustion engine for a short time and then restarting the internal combustion engine as in idle stop control, residual heat of the exhaust pipe or the catalyst remains, and the catalyst can be activated in a shorter time than cold start. In this case, however, it is difficult to accurately estimate the residual heat, and the ignition timing retardation and the intake air amount increase are carried out more than necessary after the restart after stopping the internal combustion engine for a short time so that the emission amount of harmful gas components of the exhaust gas increases.

Therefore, it is possible to accurately estimate the exhaust pipe temperature during the stop of the internal combustion engine according to the embodiment of the present invention described above, and thus, the decrease of the catalyst temperature can be predicted based on the estimation. Therefore, it is possible to accurately grasp a catalyst activation timing after the restart, and to suppress the ignition timing retardation and the intake air amount increase to the minimum, thereby suppressing the emission amount of harmful components of the exhaust gas.

As described above, according to the present invention, it is configured to obtain the first correction information based on the change of the exhaust pipe temperature and the elapsed time at the stop, the second correction information based on the change of the internal combustion engine temperature at the stop of the internal combustion engine, and the third correction information based on the change of the cooling degree due to outdoor air during stop from the stop to restart, to correct the stop-time estimation exhaust pipe temperature at the stop using at least one or more pieces of the correction information at restart of the internal combustion engine to estimate the restart-time estimation exhaust pipe temperature at the restart, and to obtain the estimation exhaust pipe temperature during the operation of the internal combustion engine thereafter using the restart-time estimation exhaust pipe temperature as the initial value, and further, to start the heating operation of the sensor heater when the estimation exhaust pipe temperature becomes equal to or higher than the predetermined value.

Accordingly, the restart-time estimation exhaust pipe temperature can be accurately estimated, and thus, it is possible to properly heat the exhaust gas sensor and activate the exhaust gas sensor at an early stage while suppressing damage of the sensor element of the exhaust gas sensor. As a result, it is possible to accelerate start of air-fuel ratio feedback and to promote reduction of harmful components of the exhaust gas.

Incidentally, the present invention is not limited to the above-described embodiments, and includes various modification examples. For example, the above-described embodiments have been described in detail in order to describe the present invention in an easily understandable manner, and are not necessarily limited to one including the entire configuration that has been described above. In addition, some configurations of a certain embodiment can be substituted by configurations of another embodiment, and further, a configuration of another embodiment can be also added to a configuration of a certain embodiment. In addition, addition, deletion, or substitution of other configurations can be made with respect to some configurations of each embodiment.

REFERENCE SIGNS LIST

10 internal combustion engine
11 water temperature sensor
12 cylinder
13 ignition coil
14 spark plug
15 crank angle sensor
16 cam angle sensor
17 intake pipe
18 fuel injection valve
19 throttle valve
20 throttle position sensor
21 intake pipe pressure sensor
22 air flow sensor
23 intake air temperature sensor
24 fuel tank
25 fuel pump
26 fuel pressure control valve
27 exhaust pipe
28 exhaust gas sensor
29 exhaust temperature sensor
30 exhaust gas catalyst
31 CPU
32 ROM
33 RAM
34 A/D converter
35 digital input circuit
36 pulse input circuit
37 digital output circuit
38 pulse output circuit
39 communication circuit
40 sensor element
40*s* surface region
40IN internal region
48 sensor signal processing circuit
47 sensor heater
49 transistor
50 battery
ECU control device

The invention claimed is:

1. An exhaust pipe temperature estimation device comprising: a control device, the control device comprising a non-transitory computer-readable medium storing a computer program therein, which when executed, causes the control device to perform operations comprising:

detecting an operation state quantity of an internal combustion engine and estimating an exhaust pipe temperature based on the operation state quantity, wherein estimating the exhaust pipe temperature comprises:

obtaining first correction information based on a change of an exhaust pipe temperature and an elapsed time ata stop of the internal combustion engine;

obtaining second correction information based on a change of an internal combustion engine temperature at the stop of the internal combustion engine;

obtaining third correction information based on a change of a cooling degree due to outdoor air during a stop from the stop to restart of the internal combustion engine;

correcting a stop-time estimation exhaust pipe temperature (Tpend), stored when the internal combustion engine has stopped, using at least one or more pieces of the correction information at restart of the internal combustion engine to estimate a restart-time estimation exhaust pipe temperature (Tp*) at the restart a;

obtaining an estimation exhaust pipe temperature (Tp) during an operation of the internal combustion engine thereafter using the restart-time estimation exhaust pipe temperature (Tp*) as an initial value; and multiplying the stop-time estimation exhaust pipe temperature (Tpend) by the first correction information, the second correction information, and the third correction information to obtain the restart-time estimation exhaust pipe temperature (Tp*).

2. The exhaust pipe temperature estimation device according to claim 1, wherein the first correction information is an exhaust pipe temperature decrease coefficient Tx, which becomes smaller in response to an elapsed time from the stop set for each stop-time estimation exhaust pipe temperature (Tpend) at the stop of the internal combustion engine, and the exhaust pipe temperature decrease coefficient Tx is stored in a memory contained within the control device.

3. The exhaust pipe temperature estimation device according to claim 1, wherein the second correction information is a warm-up heat dissipation coefficient Ty which becomes smaller in response to the internal combustion engine temperature at the stop of the internal combustion engine, and the warm-up heat dissipation coefficient Ty is stored in a memory contained within the control device.

4. The exhaust pipe temperature estimation device according to claim 1, wherein the third correction information is a cooling coefficient Tz that is set based on a temperature change amount between the stop and the restart of the internal combustion engine and an elapsed time from the stop and becomes smaller as the temperature change amount increases if the elapsed time is identical, and the cooling coefficient Tz is stored in a memory contained within the control device.

5. A sensor heater control apparatus for an exhaust gas sensor comprising:

a control device, the control device comprising a non-transitory computer-readable medium storing a computer program therein, which, when executed, causes the control device to perform operations comprising: detecting an operation state quantity of an internal combustion engine; estimating an exhaust pipe temperature based on the operation state quantity; and controlling a heating operation of a sensor heater of the exhaust gas sensor provided in an exhaust pipe based on the estimated exhaust pipe temperature;

wherein estimating the exhaust pipe temperature comprises:

obtaining first correction information based on a change of an exhaust pipe temperature and an elapsed time at stop of the internal combustion engine;

obtaining second correction information based on a change of an internal combustion engine temperature at the stop of the internal combustion engine;

obtaining third correction information based on a change of a cooling degree due to outdoor air during stop from the stop to restart of the internal combustion engine;

correcting a stop-time estimation exhaust pipe temperature (Tpend) stored when the internal combustion engine has stopped using at least one or more pieces of the correction information at restart of the internal combustion engine to estimate an restart-time estimation exhaust pipe temperature (Tp*) at the restart;

obtaining an estimation exhaust pipe temperature (Tp) during an operation of the internal combustion engine thereafter using the restart-time estimation exhaust pipe temperature (Tp*) as an initial value; and multiplying the stop-time estimation exhaust pipe temperature (Tpend) by the first correction information, the second correction information, and the third correction information to obtain the restart-time estimation exhaust pipe temperature (Tp*); and wherein controlling the heating operation of the sensor heater comprises starting the heating operation of the sensor heater when the estimation exhaust pipe temperature (Tp) during an operation becomes equal to or higher than a predetermined value.

6. The sensor heater control apparatus for an exhaust gas sensor according to claim 5, wherein the first correction information is an exhaust pipe temperature decrease coefficient Tx, which becomes smaller in response to an elapsed time from the stop set for each stop-time estimation exhaust pipe temperature at the stop of the internal combustion engine, and the exhaust pipe temperature decrease coefficient Tx is stored in a memory contained within the control device.

7. The sensor heater control apparatus for an exhaust gas sensor according to claim 5, wherein the second correction information is a warm-up heat dissipation coefficient Ty which becomes smaller in response to the internal combustion engine temperature at the stop of the internal combustion engine, and the warm-up heat dissipation coefficient Ty is stored in a memory contained within the control device.

8. The sensor heater control apparatus for an exhaust gas sensor according to claim 5, wherein the third correction information is a cooling coefficient Tz that is set based on a temperature change amount between the stop and the restart of the internal combustion engine and an elapsed time from the stop and becomes smaller as the temperature change amount increases if the elapsed time is identical, and the cooling coefficient Tz is stored in a memory contained within the control device.

9. A sensor heater control apparatus for an exhaust gas sensor comprising:

a control device, the control device comprising a non-transitory computer-readable medium storing a computer program therein, which, when executed, causes the control device to perform operations comprising:

estimating a temperature of an exhaust pipe during an operation of an internal combustion engine to obtain an estimation exhaust pipe temperature;

detecting an own temperature state of the internal combustion engine;

detecting a time during which the internal combustion engine is stopped;

obtaining a first correction coefficient (Tz) based on changes of an exhaust pipe temperature and an elapsed time at stop of the internal combustion engine;

obtaining a second correction coefficient (Ty) based on a change of the own temperature of the internal combustion engine at the stop of the internal combustion engine;

obtaining a third correction coefficient (Tz) based on a change of a cooling degree due to outdoor air during stop from the stop to restart of the internal combustion engine;

obtaining a restart-time estimation exhaust pipe temperature (Tp*) at the restart of the internal combustion engine by performing calculation of Tp*=Tpend×Tx×

Ty×Tz based on a stop-time estimation exhaust pipe temperature (Tpend), stored when the internal combustion engine is stopped, at the restart of the internal combustion engine; and starting a heating operation of the sensor heater when an estimation exhaust pipe temperature (Tp) during the operation of the internal combustion engine estimated by the exhaust pipe temperature estimation means is equal to or higher than a predetermined value;

wherein the control device obtains the estimation exhaust pipe temperature (Tp) during the operation of the internal combustion engine thereafter, with the restart-time estimation exhaust pipe temperature (Tp*) as an initial value.

10. The sensor heater apparatus of claim 9, wherein the control device sets the first correction coefficient (Tx) based on a predetermined elapsed time zone.

11. The sensor heater apparatus of claim 9, wherein the control device sets the second correction coefficient (Ty) based on a predetermined coolant temperature range.

12. The sensor heater apparatus of claim 9, wherein the control device sets the third correction coefficient (Tz) based on a difference in coolant temperature during an elapsed time zone.

* * * * *